United States Patent [19]

Riollet et al.

[11] 4,215,552

[45] Aug. 5, 1980

[54] METHOD FOR THE OPERATION OF A POWER GENERATING ASSEMBLY

[75] Inventors: Gilbert Riollet; Jacques Bruneau, both of Paris, France

[73] Assignee: Alsthom-Atlantique, Paris, France

[21] Appl. No.: 874,172

[22] Filed: Feb. 1, 1978

[30] Foreign Application Priority Data

Feb. 9, 1977 [FR] France ..... 77 03591

[51] Int. Cl.[2] ..... F01K 13/02

[52] U.S. Cl. ..... 60/646; 60/657; 60/667; 415/17

[58] Field of Search ..... 60/646, 657, 664, 665, 60/667; 417/17, 30, 47

[56] References Cited

U.S. PATENT DOCUMENTS

| | | | |
|---|---|---|---|
| 3,247,671 | 4/1966 | Daniels | 60/665 |
| 3,446,224 | 5/1969 | Zwicky, Jr. | 415/47 X |
| 3,545,207 | 12/1970 | Barber | 60/664 X |
| 3,561,216 | 2/1971 | Moore | 60/646 |
| 4,120,159 | 10/1978 | Matsumoto | 60/667 |
| 4,121,424 | 10/1978 | Sato et al. | 60/657 X |

*Primary Examiner*—Allen M. Ostrager

*Attorney, Agent, or Firm*—Sughrue, Rothwell, Mion, Zinn and Macpeak

[57] ABSTRACT

The invention provides a method for operating a power generating assembly which assembly comprises a steam generator and a turbine, and said method comprises controlling the quantity of heat released by the steam generator by a signal which is representative of the difference between the predicted stresses which will exist at the instant $to+T$ on that part of the turbine which undergoes the greatest thermal stress and the maximum permissible stress on this same part at the same instant, *to* being the present instant and T being a period of time close to the time constant of the power production assembly.

7 Claims, 3 Drawing Figures

METHOD FOR THE OPERATION OF A POWER GENERATING ASSEMBLY

FIELD OF THE INVENTION

The invention relates to a method for operating a power generating assembly.

BACKGROUND OF THE INVENTION

A power generating assembly comprises for example a steam generator (nuclear boiler or reactor) associated with a turbine. An alternator which transforms the mechanical power of the turbine into electric power is generally coupled to this turbine.

A steam generator and turbine assembly is controlled by varying the rate at which heat is supplied to the generator or steam is supplied to the turbine, or by varying both of these factors simultaneously, to adjust the power supplied by the assembly to match the power required by the user.

This problem of the adjusting the power supplied by the assembly to the power requirement gives rise to difficulties.

Indeed, all transient operating states of the assembly such as a change in the rate of steam delivery or a change in the temperature of the steam give rise to mechanical and thermal stresses at various components of the turbine.

In particular, the disks of the first wheels of the turbine, or their extension in the central shaft of the rotor, are subjected to the greatest stresses; transient states which are too sudden can generate thermal stresses which are too high, causing the machine to break, particularly at the disks.

Until quite recently, operators of such assemblies only had empirical guide lines, based on experience, for operating such assemblies under operating conditions not envisaged in the operation manuals.

In practice, the said operators allowed for large safety margins; the result of this was that the power production assembly did not respond to the user's power requirements as quickly as would have been possible without exceeding the maximum permissible stresses for the equipment.

To facilitate the task of the operators of power production assemblies, means have been devised which make it possible to calculate at any instant the difference between the current stress at the most vulnerable point of the machine and the maximum permissible stress at the same point. But knowledge of this difference at a present instant is insufficient for operating an installation properly; indeed, the fact of having the value of such a difference available at a present instant does not make it possible to predict with certainty that the stress will remain acceptable without damage to the equipment in a near future, since the time constants of such assemblies are generally fairly large (about ten minutes).

The increased power demand of the modern world makes it essential that power production assemblies operate at the limits of their capabilities; in particular, it is necessary for an assembly to start up as quickly as the maximum permissible stresses allow. It is also desirable that each change in the power required should give rise to a transient state of the machine which lasts for as short a time as possible while guaranteeing that the stresses which the equipment undergoes remain within the permissible limits.

SUMMARY OF THE INVENTION

The present invention provides a method of operating a power generating assembly, said assembly comprising a steam generator and a turbine. The method comprises controlling the quantity of heat released by the steam generator by a signal which is representative of the difference between the predicted stress which will exist at the instant $to+T$ on that part of the turbine which undergoes the greatest thermal stress and the maximum permissible stress on this same part at the same instant, *to* being the present instant and T being a period of time close to the time constant of the power production assembly.

The invention will be explained hereinbelow by a detailed description of an example of the method applied to a generator-turbine set and with reference to the accompanying drawings.

DESCRIPTION OF THE PREFERRED EMBODIMENTS

Figure 1:
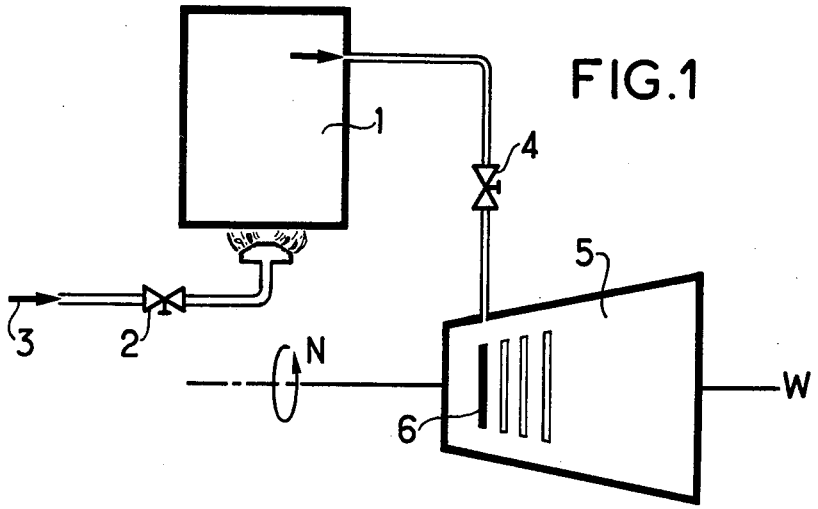
FIG. 1 shows schematically a power production assembly.

FIG. 1 shows a power production assembly comprising a boiler 1 supplying at its output a fluid (steam) whose temperature and flow rate can be modified by means schematically shown respectively by a cock 2 for the input of fuel 3 and an inlet cock 4 to a turbine 5. The first blade wheel of the turbine is shown schematically at 6.

The greatest stresses are developed at the disks of this wheel. The turbine rotates at a speed of N rpm and produces a power W.

Figure 2:
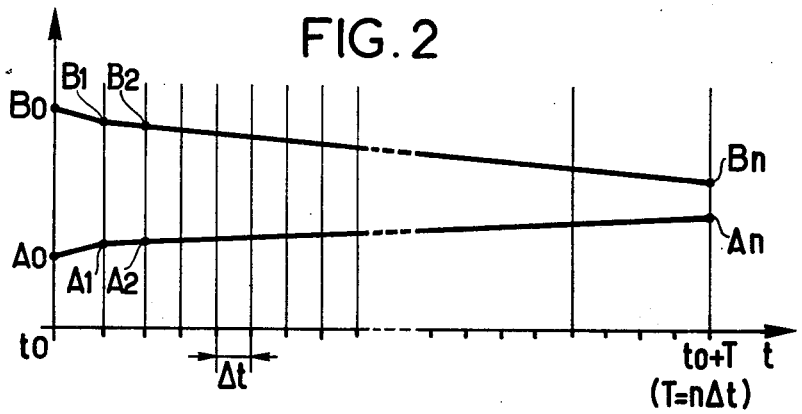
FIG. 2 is a graph illustrating the method of the invention.

A signal representative of the operation state of the assembly is formed as described hereinbelow with reference to the graph of FIG. 2. In this graph, time t is plotted along the X-axis and stress is plotted along the Y-axis.

At the present instant *to*, the point Ao is representaive of a present stress on the disk of the wheel (6) and the point Bo is representative of the maximum permissible stress at the same point at the same instant.

Although the disk is not accessible to direct measurement, it is possible to calculate the Y-axis values of Ao and Bo. For this purpose, the pressures and temperatures upstream of the turbine and the pressure downstream from the wheel (6) are measured. From these measurements, it is easy to determine, for example, by means of Stodola's equation, the flow rate of the fluid and the characteristics of this fluid (pressure, temperature and coefficient of temperature exchange with the metal of the disk).

The knowledge of the above data makes it possible to calculate the temperature distribution in the rotor and to calculate therefrom an average temperature. The thermal stress can then be calculated from the data supplied by the manufacturer of the machine, such as the Young's modulus of the material, its coefficient of thermal expansion and its Poisson's ratio.

The time which elapses after the present instant *to* until the instant $to+T$, where T is of the order of magnitude of the time constant of the installation, (for example 10 minutes) is divided into n equal intervals t, of about 10 seconds each for example; the probable future stresses Ak and Bk are determined for each of the instants $to+kt$. Thus, for each instant after $to$, it is possible to calculate the difference Bk−Ak between the maximum permissible stress Bk and the predicted stress Ak. In particular, importance is attached to the difference between the maximum permissible stress Bn at the instant $to+T$ and the predicted future stress at that instant.

The future stresses (predicted and maximum permissible) are determined by assuming, at each step of the calculation, that the change of the parameters used (temperature, pressure and flow rate of the input fluid) can be deduced from their change since the preceding instant $to$. Of course, account must be taken of any predicted change in these parameters that is expected to occur during the period $to$ to $to+T$ because of some variation in the load or in the power supplied.

The signal used in the method is proportional to K where:

$$\delta K = \delta\left[\frac{Bn - An}{Bn}\right]$$

where Bn is the maximum permissible stress at the instant $to+T$; $to$ is the present instant; T is equal to or close to the time constant of the installation; An is the predicted future stress at the instant $to+T$, and $\delta$ is equal to +1 or −1 according to whether the installation is respectively being heated or being cooled.

The knowledge of the signal K is used as follows by the operator at the instant $to$:

(1) In a period during which the installation is being heated (starting up or increasing the power supplied):

Where K is positive, the operator knows that he has a safety margin which allows him to increase the flow rate of the fuel to the boiler and/or steam to the turbine;

Where K is zero, the operator knows that he has no safety margin and that he should in no case increase the power of the machine; and Where K is negative, there is a danger of damage at the instant $to+T$. This case will not occur in practice if the operator has taken care to use the operating method of the invention from the moment the installation was started, providing however that the steam generator has not been subjected to some accidental transient state.

(2) In a period during which the installation is being cooled (reducing the power):

Where K is positive, the operator knows either that he has a safety margin allowing him to accelerate the rate of power reduction and to reduce the flow rate of fuel to the boiler and/or steam to the turbine;

Where K is zero, the rate of power reduction is correct; and

Where K is negative, the operator must slow down the rate of power reduction and/or of temperature reduction, but as previously explained this situation should not arise.

To operate the power generating assembly properly, this signal is generated periodically, for example 3 to 4 times at regular intervals during a period T which is substantially equal to the time constant of the installation.

As a function of the modifications made by the operator to the operation of his power generating assembly, the curves A(t) and B(t) could begin by converging and then diverge during a period $to$ to $to+T$.

Figure 3:
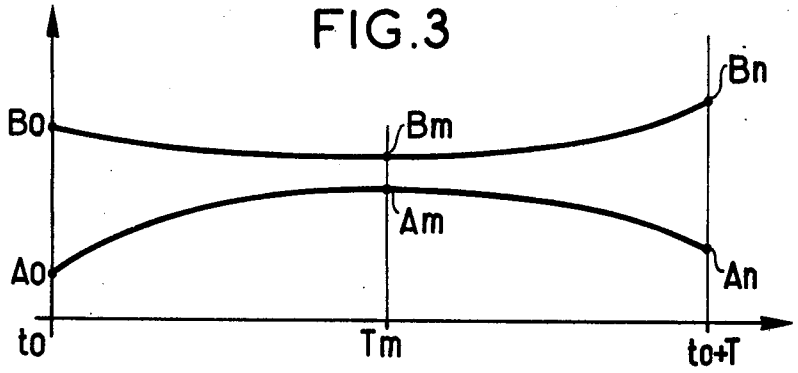
FIG. 3 is a graph illustrating a variant of the method of the invention.

An example is given in FIG. 3.

The true stress increases up to Am, then decreases. The maximum permissible stress decreases down to Bm, then increases. It is interesting for the operator to know the instant Tm of the minimum difference Bm-Am and the value of this difference.

If this time is close to $to$, the operator's actions can have little useful effect; if this time is close to T or after T, his freedom of action is great.

The signal K can be used in an automatic control unit of a power generating assembly.

During the heating period, the amplitude of the appropriate modification to the heating rate is an increasing function (for example directly proportional) to the signal K and a decreasing function (for example inversely proportional) to the time Tm defined above.

The direction of the action is reversed during cooling.

Further, it is possible for the operator of the assembly to replace future behaviour estimated on the basis of past changes with a future behaviour which he is going to impose by his actions. The parameters will be estimated during the period $to$ to $to+T$ taking into account the data supplied by the operator and the present known data multiplied by the present rate of change for those parameters which have a time constant of more than 30 seconds.

What is claimed is:

1. A method of operating a power generating assembly, said assembly comprising a steam generator and a turbine, said method comprising the step of controlling the quantity of heat released by the steam generator by a signal which is representative of the difference between the predicted stresses which will exist at the instant $to+T$ on that part of the turbine which undergoes the greatest thermal stress as determined by measuring the temperature, pressure and flow rate of steam supplied by said steam generator to said turbine and the maximum permissible stress on this same part at the same instant, where; $to$ is the present instant and T is a period of time close to the time constant of the power production assembly.

2. A method according to claim 1, wherein said signal is proportional to the quantity $$\delta\left[\frac{Bn - An}{Bn}\right]$$

in which:

Bn is the maximum permissible stress on said part at the instant $to+T$,

An is the predicted stress on said art at the instant to +T; and $\delta$ is equal to +1 if said part is being heated and equal to −1 if said part is being cooled.

3. A method according to claim 2, wherein the prediction of the stress at the instant $to+T$ is made on the assumption that the parameters producing the thermal stress (temperature, pressure and discharge of the steam) continue to change after $to$ at the same constant rate as they actually changed during a preceding time interval of predetermined duration.

4. A method according to claim 1, wherein the signal is used to control the operation of the assembly by the following steps:

(a) when the observed part is being heated and the signal is positive;
increasing the rate at which the boiler is heated;

(b) when the observed part is being cooled and the signal is positive;
increasing the rate at which the heating rate of the boiler is being reduced.

5. A method according to claim 1, wherein said assembly comprises an automatic control unit and wherein the amplitude of the modification made to the heating rate being an increasing function of the signal during the heating period of the assembly.

6. A method according to claim 5, wherein the amplitude of the modifications made to the heating rate during the heating period is a decreasing function of the period of time separating the present instant *to* and the instant *to*+Tm at which the difference between the maximum permissible stress on said part and the predicted stress on the same part is at a minimum.

7. A method according to claim 1, wherein the signal is used to control the operation of the assembly by the following steps:

(a) when the observed part is being heated and the signal is positive;
increasing the rate at which the steam is delivered;

(b) when the observed part is being cooled and the signal is positive;
increasing the rate at which the steam delivery is being reduced.

* * * * *